US008186674B2

(12) United States Patent
Fujita

(10) Patent No.: US 8,186,674 B2
(45) Date of Patent: May 29, 2012

(54) IMAGE FORMING APPARATUS

(75) Inventor: Keiko Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/239,704

(22) Filed: Sep. 22, 2011

(65) Prior Publication Data

US 2012/0007308 A1 Jan. 12, 2012

Related U.S. Application Data

(62) Division of application No. 13/026,586, filed on Feb. 14, 2011, now Pat. No. 8,047,539.

(30) Foreign Application Priority Data

Feb. 26, 2010 (JP) ..... 2010-042837

(51) Int. Cl.
*B65H 7/02* (2006.01)

(52) U.S. Cl. ..... 271/259; 271/258.01; 271/225; 271/902; 399/124; 399/370

(58) Field of Classification Search ..... 271/258.01, 271/259, 225, 902; 399/124, 370
See application file for complete search history.

(56) References Cited

U.S. PATENT DOCUMENTS

| | | | | |
|---|---|---|---|---|
| 6,741,815 | B1 | 5/2004 | Fujita et al. | |
| 7,085,504 | B2 * | 8/2006 | Matsuyama et al. | 399/124 |
| 7,597,311 | B2 | 10/2009 | Kawata et al. | |
| 2004/0234280 | A1 | 11/2004 | Matsuyama et al. | |
| 2007/0059037 | A1 * | 3/2007 | Hirai | 399/124 |
| 2010/0111583 | A1 | 5/2010 | Fujita | |

FOREIGN PATENT DOCUMENTS

| | | | |
|---|---|---|---|
| JP | 5-053405 | | 3/1993 |
| JP | 05053405 | A * | 3/1993 |
| JP | 09071363 | A * | 3/1997 |
| JP | 2007-052276 | | 3/2007 |

* cited by examiner

*Primary Examiner* — Gerald McClain
(74) *Attorney, Agent, or Firm* — Fitzpatrick, Cella, Harper & Scinto

(57) ABSTRACT

If a jam detecting portion detects a sheet jam, a rear end position of the jammed sheet is computed based on information, when a rear end of the jammed sheet is located within an area A1 and a length Ls of the jammed sheet in a conveying direction of the sheet is equal to or shorter than a distance L between the area A1 and an area A2, driving operations of a pre-registration roller and a registration roller are controlled so that the jammed sheet is conveyed to a downstream until a rear end of the sheet passes through a downstream end of the area A1. When Ls is longer than L, the pre-registration roller and the registration roller are controlled so that the jammed sheet is conveyed toward the upstream until the rear end of the sheet passes through an upstream end of the area A1.

5 Claims, 11 Drawing Sheets

IMAGE FORMING APPARATUS

BACKGROUND OF THE INVENTION

This application is a divisional of U.S. patent application Ser. No. 13/026,586, filed Feb. 14, 2011, and allowed on Jul. 6, 2011.

FIELD OF THE INVENTION

The present invention relates to an image forming apparatus, and more particularly, to jam recovery when a paper jam (jam, hereinafter) occurs.

DESCRIPTION OF THE RELATED ART

In a conventional image forming apparatus such as a copying machine, a facsimile machine and a laser beam printer, there is an apparatus which forms an image on a sheet by an electrophotographic system. According to such an image forming apparatus, when an image is formed on a sheet, a photosensitive drum is exposed according to image information to form an electrostatic latent image on the photosensitive drum. Next, the electrostatic latent image is developed by toner in a development device, and visualized as a toner image, and the toner image is transferred to a sheet which is fed from a sheet feeding portion. Thereafter, the sheet is conveyed to a fixing nip of a fixing roller and a pressure roller provided on a fixing portion by a pre-fixing conveying portion, and the image is fixed to the sheet as a permanent image.

As such conventional image forming apparatuses, there is one in which a transfer member constituting a transfer portion, the pre-fixing conveying portion and the fixing portion are unitized as a pull-out unit, and the pull-out unit is pulled out from a front surface of an apparatus body. This technique is disclosed in Japanese Patent Laid-Open No. 2007-052276. By pulling out the pull-out unit in this manner, it is possible to easily carry out the jam recovery in the sheet conveying passage and maintenance of the apparatus.

However, in such a conventional image forming apparatus, the jam occurs not only in the pull-out unit, but also in a state where a sheet is jammed between the pull-out unit and an upstream sheet conveying passage through which the sheet is conveyed to the pull-out unit.

When a sheet jam occurs between pull-out unit and the upstream sheet conveying passage, the pull-out unit can be pulled out only after the upstream sheet conveying passage is opened and the jammed sheet is removed. This is because that if the pull-out unit is pulled out when a sheet exists between the pull-out unit and the upstream sheet conveying passage, there is an adverse possibility that the sheet is caught in a body frame and the sheet is torn. For this reason, it is necessary to open the upstream sheet conveying passage, but a complicated mechanism and a space for opening the sheet conveying passage are required, and there is an adverse possibility that cost of the apparatus is increased and an installation space for the apparatus is also increased in size.

SUMMARY OF THE INVENTION

The present invention has been accomplished in view of such circumstances, and the invention provides an image forming apparatus capable of reliably carrying out the jam recovery of a sheet which is jammed between the pull-out unit and the upstream sheet conveying passage with a simple configuration.

The invention provides an image forming apparatus including a pull-out unit provided in an apparatus body such that the pull-out unit can be pulled out and having a sheet conveying passage and two conveying rollers which are provided in the sheet conveying passage and which can normally and reversely rotate, wherein the image forming apparatus includes an upstream sheet conveying passage provided upstream from the pull-out unit in a sheet conveying direction for conveying a sheet to the pull-out unit, a downstream sheet conveying passage provided downstream from the pull-out unit in the sheet conveying direction for conveying the sheet from the pull-out unit, a jam detecting portion which detects a sheet jam, a sheet detecting portion which detects a sheet that passes through the sheet conveying passage of the pull-out unit, and a controlling portion which controls driving operations of the two conveying rollers, and wherein if the jam detecting portion detects a sheet jam, the controlling portion calculates a rear end position of the jammed sheet based on detection of the sheet detecting portion, and controls driving operations of the two conveying rollers such that when a rear end of the jammed sheet is in the upstream sheet conveying passage and when a distance L between the upstream sheet conveying passage and the downstream sheet conveying passage is equal to or longer than a length Ls of the jammed sheet in a conveying direction of the sheet, the jammed sheet is conveyed toward a downstream until the rear end of the sheet passes through a downstream end of the upstream sheet conveying passage, and when Ls is longer than L, the jammed sheet is conveyed toward the upstream until the rear end passes through an upstream end of the upstream sheet conveying passage.

The invention also provides an image forming apparatus including a pull-out unit provided in an apparatus body such that the pull-out unit can be pulled out and having a sheet conveying passage and two conveying rollers which are provided in the sheet conveying passage and which can normally and reversely rotate, wherein the image forming apparatus includes an upstream sheet conveying passage provided upstream from the pull-out unit in a sheet conveying direction for conveying a sheet to the pull-out unit, a downstream sheet conveying passage provided downstream from the pull-out unit in the sheet conveying direction for conveying the sheet from the pull-out unit, a jam detecting portion which detects a sheet jam, a sheet detecting portion which detects a sheet that passes through the sheet conveying passage of the pull-out unit, and a controlling portion which controls driving operations of the two conveying rollers, and wherein if the jam detecting portion detects a sheet jam, the controlling portion calculates a rear end position of the jammed sheet based on detection of the sheet detecting portion, and controls driving operations of the two conveying rollers such that when a rear end of the jammed sheet is in the upstream sheet conveying passage and when a distance L between the upstream sheet conveying passage and the downstream sheet conveying passage is equal to or longer than a length Ls of the jammed sheet in a conveying direction of the sheet, the jammed sheet is conveyed toward a downstream until the rear end of the sheet passes through a downstream end of the upstream sheet conveying passage, and when Ls is longer than L, the jammed sheet is conveyed toward the downstream until the rear end of the sheet passes through the downstream end of the upstream sheet conveying passage while bending the jammed sheet between the two conveying rollers.

Further features of the present invention will become apparent from the following description of exemplary embodiments with reference to the attached drawings.

DESCRIPTION OF THE EMBODIMENTS

Figure 1:
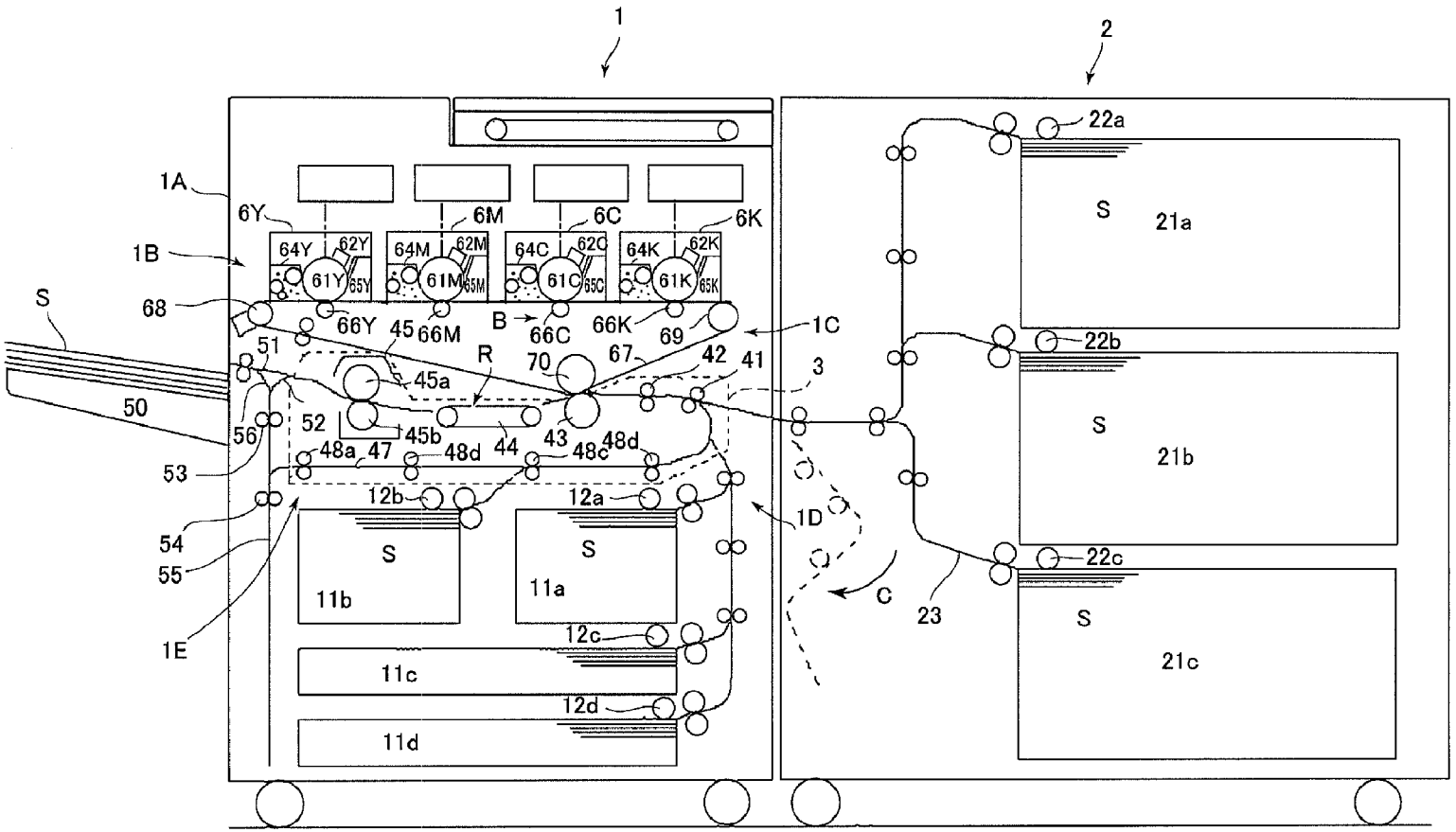
FIG. 1 is a diagram illustrating a general configuration of a color laser beam printer which is one example of the image forming apparatus according to a first embodiment of the present invention.

Modes for carrying out the present invention will be described in detail with reference to the drawings. FIG. 1 illustrates a general configuration of a color laser beam printer which is one example of an image forming apparatus according to a first embodiment of the invention. A color laser beam printer 1, and a color laser beam printer body 1A (printer body, hereinafter) which is an apparatus body are illustrated in FIG. 1.

The printer body 1A includes an image forming portion 1B which forms an image on a sheet S, an intermediate transfer portion 1C, a fixing apparatus 45, and a sheet feeding apparatus 1D which feeds a sheet S to the image forming portion 1B. The color laser beam printer 1 can form an image on a back surface of a sheet S. For this reason, the color laser beam printer 1 includes a re-conveying portion 1E which turns over a sheet S having an image formed on its front surface (one surface), and which again conveys the sheet S to the image forming portion 1B.

The image forming portion 1B includes four process stations 6 (6Y, 6M, 6C and 6K) which are disposed substantially in a horizontal direction and which form toner images of four colors (yellow (Y), magenta (M), cyan (C) and black (Bk)). The process stations 6 include photosensitive drums 61 (61Y, 61M, 61C and 61K) as image bearing members which bear toner images of four colors (yellow, magenta, cyan and black) and which are driven by stepping motors (not illustrated). The process stations 6 also include electrification apparatuses 62 (62Y, 62M, 62C and 62K) which uniformly electrify surfaces of the photosensitive drums.

The process stations 6 also include exposure apparatuses 63 (63Y, 63M, 63C and 63K) which apply laser beam based on image information, and which form electrostatic latent images on the photosensitive drums that rotate at constant velocity. The process stations 6 also include development apparatuses 65 (65Y, 65M, 65C and 65K) in which toner of yellow, magenta, cyan and black adhere to electrostatic latent images formed on the photosensitive drums to visualize the electrostatic latent images as toner images. These electrification apparatuses 62, the exposure apparatuses 63, and the development apparatuses 65 are respectively disposed around the photosensitive drums 61 along their rotating directions.

The sheet feeding apparatus 1D includes sheet cassettes 11*a* to 11*d* which are sheet accommodating portions provided at lower portions of the printer body and in which sheets S are accommodated, and also includes 12*a* to 12*d* which send out sheets S stacked and accommodated in the sheet cassettes 11*a* to 11*d*. If an image forming operation is started, sheets S are separated from the sheet cassettes 11*a* to 11*d* and fed by the pickup rollers 12*a* to 12*d* one sheet by one sheet and then, the sheets S are conveyed by registration rollers 42 through pre-registration rollers 41.

The registration rollers 42 have such a function that a sheet S abuts against the registration rollers 42 to form a loop, and a tip end of the sheet S follows to correct skew feeding. The registration rollers 42 have a function to convey a sheet S to a secondary transfer portion when an image is formed on the sheet S, i.e., at predetermined timing according to a toner image borne on a below-described intermediate transfer belt. When a sheet S is conveyed, the registration rollers 42 stop, the sheet S abuts against the stopped registration rollers 42, and the sheet is bent. Thereafter, a tip end of the sheet S is flush with a nip of the registration rollers 42 by rigidity of the sheet, and the skew feeding of the sheet S is corrected. Thereafter, if the skew feeding of the sheet S is corrected, the registration rollers 42 are driven at such timing that a toner image formed on an intermediate transfer belt 67 and a tip end of a sheet S match with each other as will be described below.

The intermediate transfer portion 1C includes the intermediate transfer belt 67 which is rotated and driven along an arranging direction of the process stations 6 illustrated with arrow B in synchronism with outer circumferential velocity of the photosensitive drum 61. The intermediate transfer belt 67 is wound around a drive roller 68, a follower roller 70 which forms a secondary transfer region between the intermediate transfer belt 67 and the follower roller 70, and a tension roller 69 which applies appropriate tension to the intermediate transfer belt 67 by a biasing force of a spring (not illustrated). Four primary transfer rollers 66 (66Y, 66M, 66C and 66K) which nip the intermediate transfer belt 67 together with the photosensitive drums 61 and which constitute the primary transfer portion are disposed on an inner side of the intermediate transfer belt 67. The primary transfer rollers 66 are connected to a transfer bias power supply (not illustrated). Transfer bias is applied to the intermediate transfer belt 67 from the primary transfer rollers 66, toner images of respective colors on the photosensitive drums are sequentially transferred to the intermediate transfer belt 67 in a multilayer manner, and a full color image is formed on the intermediate transfer belt 67.

A secondary transfer roller 43 is disposed such that it is opposed to the follower roller 70, the secondary transfer roller 43 abuts against a lowermost surface of the intermediate transfer belt 67, and nips and conveys a sheet S conveyed by the registration rollers 42 together with the intermediate transfer belt 67. When the sheet S passes through the secondary transfer roller 43 and the nip portion (secondary transfer portion) of the intermediate transfer belt 67, bias is applied to the secondary transfer roller 43, thereby secondary transferring a toner image on the intermediate transfer belt to the sheet S.

The fixing apparatus 45 constituting the fixing portion fixes, onto a sheet S, a toner image formed on the sheet through the intermediate transfer belt 67, and includes a fixing roller 45*a* and a pressure roller 45*b*. When the sheet S which holds a toner image passes through the fixing roller 45*a* and a nip (fixing nip) of the pressure roller 45*b* of the fixing apparatus 45, heat and pressure are applied to the sheet S, and the toner image is fixed.

In FIG. 1, the printer includes a sheet deck 2 which is optionally connected to a printer body 2A. Sheets S are selectively fed to the secondary transfer portion by pickup rollers 22*a* to 22*c* from sheet accommodating portions 21*a* to 21*c* provided on the sheet deck 2. An open guide 23 is provided in the sheet deck 2. When a jammed sheet is recovered as will be described below, the open guide 23 is opened as illustrated with arrow C in FIG. 1.

Next, the image forming operation of the color laser printer 1 having the above-described configuration will be described. If the image forming operation is started, in the process station 6Y located on the most upstream in the rotating direction of the intermediate transfer belt 67, the photosensitive drum 61Y is irradiated with laser by the exposure apparatus 63Y, and a yellow latent image is formed on the photosensitive drum. Then, the latent image is developed by yellow toner by the development apparatus 65Y, and a yellow toner image is formed. Next, the yellow toner image formed on the photosensitive drum 61Y is primarily transferred to the intermediate transfer belt 67 in a primary transfer region by the primary transfer roller 66Y to which high voltage is applied.

Next, together with the intermediate transfer belt 67, the toner image is conveyed to a primary transfer region having the photosensitive drum 61M and the transfer roller 66M of the next process station 6M in which an image is formed with delay, from the process station 6Y, for time during which the toner image is conveyed. A next magenta toner image is transferred such that a tip end of the image is aligned with the yellow toner image on the intermediate transfer belt. Thereafter, the same step is repeated and as a result, toner images of the four colors are primarily transferred onto the intermediate transfer belt 67, and a full color image is formed on the intermediate transfer belt. Toner which has remained slightly on the photosensitive drum after the transfer is collected by the photosensitive cleaners 64 (64Y, 64M, 64C and 64K) and is kept for the next image forming operation.

Simultaneously with the toner image forming operation, sheets S accommodated in the sheet cassettes 11*a* to 11*d* are separated one sheet by one sheet by the pickup rollers 12*a* to 12*d* and fed and then, the sheets S are conveyed to the registration rollers 42 through the pre-registration rollers 41. When sheets S are selectively fed from the sheet accommodating portions 21*a* to 21*c* of the sheet deck 2 by the pickup rollers 22*a* to 22*c*, the sheets S are conveyed to the registration rollers 42 through the pre-registration rollers 41.

At that time, the registration rollers 42 stop, a sheet S abuts against the stopped registration rollers 42, thereby correcting skew feeding of the sheet S. After the skew feeding is corrected, the sheet S is conveyed to the nip portion of the secondary transfer roller 43 and the intermediate transfer belt 67 by the registration rollers 42 which start rotating when the tip end of the sheet and the toner image formed on the intermediate transfer belt 67 match with each other. When the sheet passes through the nip portion of the secondary transfer roller 43 and the intermediate transfer belt 67, a toner image on the intermediate transfer belt is secondarily transferred to the sheet S by bias which is applied to the secondary transfer roller 43.

Next, the sheet S to which the toner image is secondarily transferred is conveyed to the fixing apparatus 45 by a pre-fixing conveying apparatus 44 which constitutes a pre-fixing conveying portion and which adsorbs and conveys a sheet S. The fixing apparatus 45 melts and fixes a toner image on the sheet S by heating and pressurizing the toner image by the fixing roller 45*a* and the pressure roller 45*b*. Although the fixing roller 45*a* is used as a unit for pressurizing a sheet S in this embodiment, a heating belt which is heated by a heat source such as a heater may be used instead of the fixing roller 45*a*.

The color laser printer 1 includes a face-up mode in which a sheet on which an image is formed is ejected onto a discharge tray such that a surface of the sheet on which the image is formed faces up, a face-down mode in which a surface of the sheet on which the image is formed faces down, an automatic duplex mode in which images are formed on both front and back surfaces of a sheet. A switching member (not illustrated) selects one of paths so that a sheet S having a fixed image is conveyed to the discharging/conveying path 51 in the face-up mode, and a sheet S having a fixed image is conveyed to a turn-over induction path 52 in the automatic duplex mode and the face-down mode.

When the face-up mode is selected, a sheet S having a fixed image is discharged to a discharge tray 50 which is a sheet stacking portion through an inner discharge roller 46 and a discharge/conveying path 51 which is a discharge passage. When the automatic duplex mode is selected, a sheet S is pulled into a switchback path 55 by a pair of first turn-over rollers 53 and a pair of second turn-over rollers 54 through the turn-over induction path 52 which branches off from the discharge/conveying path 51.

Thereafter, the pair of second turn-over rollers 54 is reversely rotated from normal rotation, i.e., a switchback operation is carried out, thereby switching between a tip end and a rear end, and a sheet is conveyed to a duplex conveying path 47. Then, the sheet S is sent to a secondary transfer portion through the registration rollers 42 by duplex rollers 48*a* to 48*d* at timing of a successor job which is conveyed by the pickup rollers 12*a* to 12*d*. The image forming process for a back surface (second surface) is the same as that of the above-described front surface (first surface).

In the case of the face-down mode which is a turn-over discharge mode in which a sheet S is turned over and discharged, a sheet S which has passed through the fixing apparatus 45 is turned upside down and a forward direction and a backward direction are switched and the sheet S is discharged to the discharge tray 50. Therefore, when the face-down mode is selected, a sheet S which passed through the fixing apparatus 45 is pulled into the switchback path 55 by normal rotations of the pair of first turn-over rollers 53 and the pair of second turn-over rollers 54 from the turn-over induction path 52. The pulled sheet S is conveyed, by reverse rotations of the pair of first turn-over rollers 53 and the pair of second turn-over rollers 54, in a direction opposite from the pulled direction such that a rear end of the sheet S when the sheet S is sent is led to a turn-over discharge path 55 via a turn over discharge roller 56 and the sheet S is discharged into the discharge tray 50.

In FIG. 1, the printer includes the pull-out unit 3 which is integrally provided with the pre-registration rollers 41, the registration rollers 42, the secondary transfer roller 43, the pre-fixing conveying apparatus 44, the fixing apparatus 45, the inner discharge roller 46, the duplex conveying path 47 and a duplex roller 48. The pull-out unit 3 is provided in the printer body 1A such that the pull-out unit 3 can be pulled out.

Figure 2:
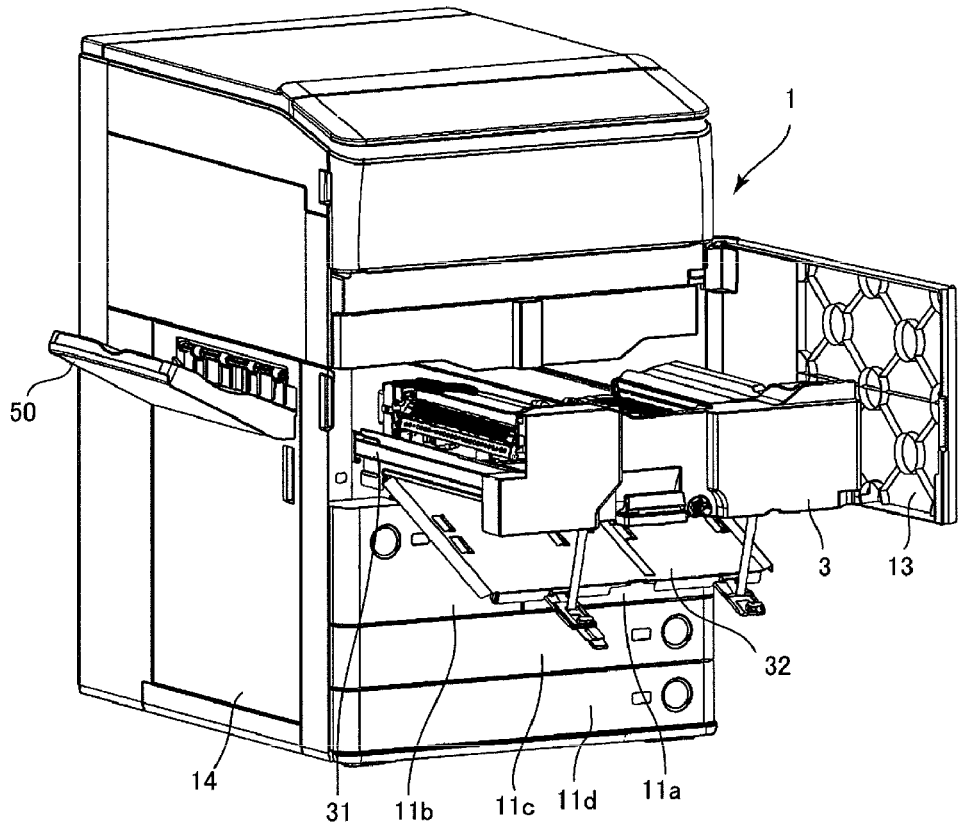
FIG. 2 is a perspective view illustrating a state where the pull-out unit of the color laser beam printer is pulled out.

When a sheet jam occurs in a sheet conveying passage R including the duplex conveying path 47 in the pull-out unit 3, a front cover 13 is opened as illustrated in FIG. 2 and then, the pull-out unit 3 is pulled out from a front surface of the printer body by a slide rail 31. After the pull-out unit 3 is pulled out, a lower guide 32 of the duplex conveying path 47 can be opened downward.

According to this configuration, when a sheet jam occurs in the sheet conveying passage R in the pull-out unit 3, the jam recovery can be carried out in a state where a visual condition and an access condition are excellent, and the jam recovery operability is enhanced. As compared with a configuration in which the pre-registration rollers 41 and the registration rollers 42 are individually pulled out, a slide mechanism and a frame body can be omitted, it is unnecessary to previously provide a jam recovery space up to a sheet cassette 11, and this is effective for reducing the apparatus in size. The sheet cassette 11 and a sheet accommodating portion 21 of the sheet deck 2 can also be pulled out forward, and sheets can be added. Therefore, the sheets-adding operation and the jam recovery can be carried out from the same direction, and the operability is enhanced.

Figure 3:
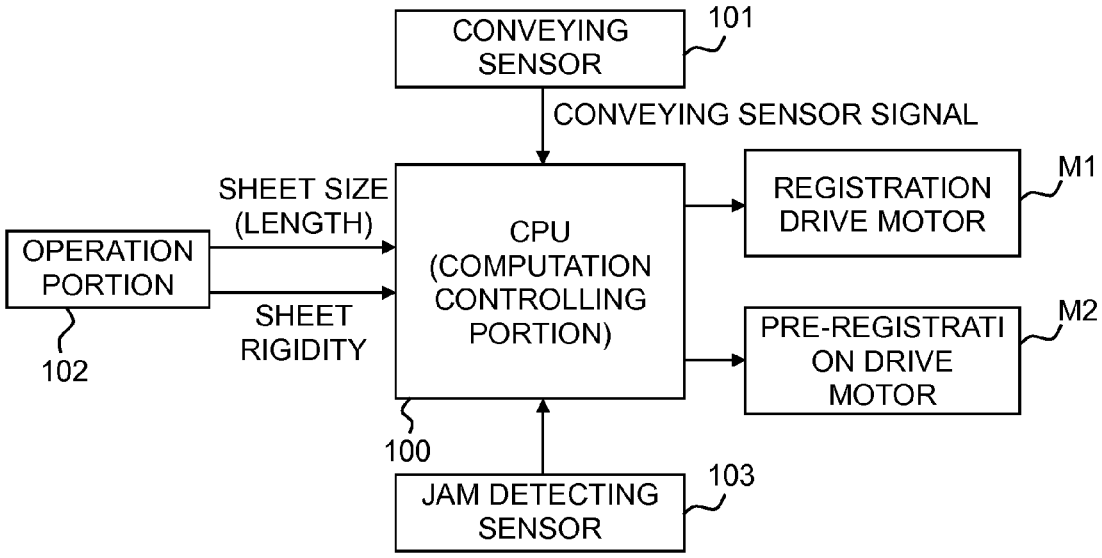
FIG. 3 is a control block diagram of the color laser beam printer.

FIG. 3 is a control block diagram of the color laser printer 1. In FIG. 3, the printer includes a CPU (arithmetic controlling portion) 100. A reference number 101 represents a conveying sensor which is a sheet detecting portion for detecting a sheet conveyed into the pull-out unit 3 for computing a tip end position and a rear end position of a sheet. A reference number 102 represents an operation portion for inputting size information of sheets such as a length in the sheet conveying direction and rigidity information of a sheet. A reference number 103 represents a jam detecting sensor which is a jam detecting portion for detecting a sheet jam in the sheet conveying passage in the pull-out unit 3.

The conveying sensor 101 inputs, to the CPU 100, a conveying sensor signal indicating that a tip end and a rear end of a sheet has passed. The operation portion 102 inputs a sheet size signal and a sheet rigidity signal to the CPU 100. The jam detecting sensor 103 inputs a jam detecting signal to the CPU 100. A registration drive motor M1 and a pre-registration drive motor M2 which can rotate normally and reversely are connected to the CPU 100. The registration drive motor M1 and the pre-registration drive motor M2 drive the two pre-registration rollers 41 and the two registration rollers 42 which can rotate normally and reversely.

If the jam detecting signal is input from the jam detecting sensor 103, the CPU 100 normally and reversely drives the registration drive motor M1 and the pre-registration drive motor M2 based on the conveying sensor signal from the conveying sensor 101 and the sheet size signal and the sheet rigidity signal from the operation portion 102. For example, when a sheet jam occurs between the pull-out unit 3 and an area A1 and an area A2 which are conveying path on the side of the apparatus body illustrated in below-described FIGS. 4A, 4B and 4C, the registration drive motor M1 and the pre-registration drive motor M2 are normally and reversely driven according to a tip end position and a rear end position of the jammed sheet.

According to this, the pre-registration rollers 41 and the registration rollers 42 are normally and reversely driven, and by this normal and reversely driving operations of the pre-registration rollers 41 and the registration rollers 42, the jammed sheet can forcibly be accommodated in the pull-out unit. Alternatively, the jammed sheet can be pulled out from the sheet deck. When the jammed sheet is accommodated in the pull-out unit, the pull-out unit 3 can be pulled out for jam recovery.

Figure 4A:
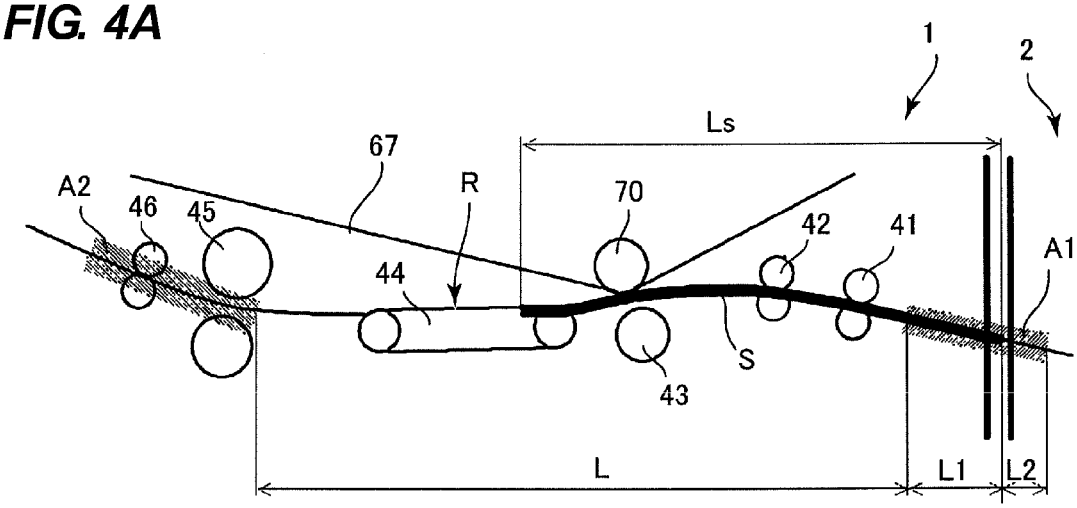
FIGS. 4A, 4B and 4C are diagrams for explaining forcible conveyance control of the color laser beam printer.
Figure 4B:
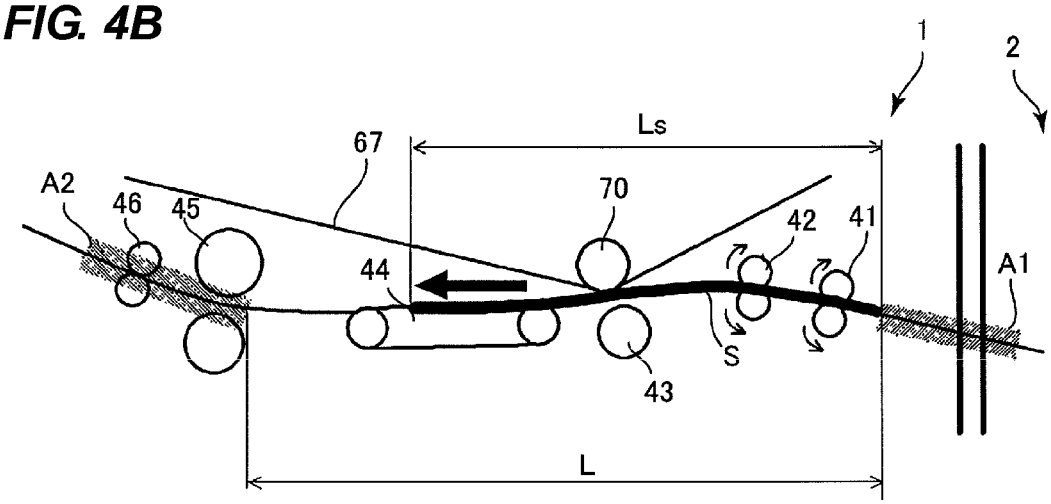
Figure 4C:
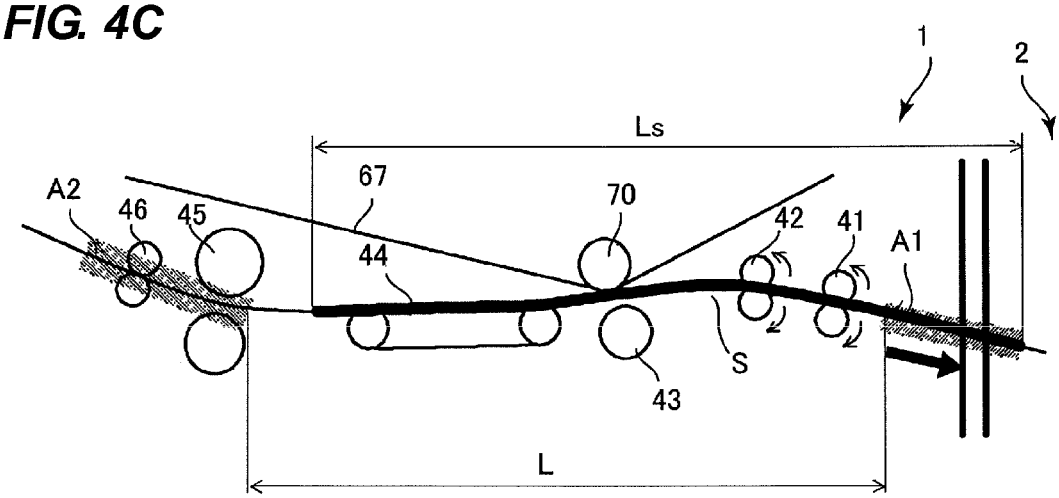

Next, forcible conveyance control of a sheet when a sheet jam occurs in a state where the sheet exists between the pull-out unit 3 and a conveying passage on the side of the apparatus body will be described with reference to FIGS. 4A, 4B and 4C. In FIGS. 4A, 4B and 4C, a reference symbol Al represents a first conveying area which is provide upstream from the pull-out unit 3 in the conveying direction of sheet and which constitutes an upstream sheet conveying passage provided on the side of the apparatus body for conveying a sheet from the sheet deck 2 to the pull-out unit 3. A sheet fed from the sheet deck 2 is conveyed to the sheet conveying passage R of the pull-out unit 3 from the first conveying area (area A1, hereinafter). When a jammed sheet exists in the area A1, the conveying guide 23 (see FIG. 1) cannot be opened unless the sheet deck 2 is separated from the printer body 1A.

In FIGS. 4A, 4B and 4C, the printer includes a second conveying area A2 which is provided downstream from the pull-out unit 3 in the conveying direction of a sheet and which constitutes a downstream sheet conveying passage provided on the side of the apparatus body for conveying a sheet from the pull-out unit 3 to the discharge/conveying path 51 through the fixing apparatus 45. The second conveying area (area A2, hereinafter) includes the fixing apparatus 45 and is disposed at a predetermined distance L from the area A1. In FIGS. 4A, 4B and 4C, a reference symbol Ls represents a length of the jammed sheet S in the conveying direction of a sheet, and a reference symbol L1 represents a distance from a rear end of a sheet S to a downstream end of the area A1 in the conveying direction of a sheet (downstream end, hereinafter). A reference symbol L2 represents a distance from a rear end of a jammed sheet S to an upstream end of the area A1 in the conveying direction of a sheet (upstream end, hereinafter).

In this embodiment, when the rear end of the jammed sheet S exists upstream from the area A1, the open guide 23 in the sheet deck is opened as illustrated with arrow C in FIG. 1. After the open guide 23 is opened, if a user grasps the rear end of the jammed sheet S and pulls out the rear end toward the upstream side, the jam recovery can be carried out. When a rear end of a jammed sheet S is located downstream from a downstream end of the area A1, if the pull-out unit 3 is pulled out as illustrated in FIG. 2 and the conveying guide 32 in the pull-out unit 3 is opened as required, the jam recovery can be carried out.

When a rear end of a jammed sheet S is located in the area A1 as illustrated in FIG. 4A, however, even if the open guide 23 of the sheet deck 2 is opened, it is not possible to access the jammed sheet S. A frame (not illustrated) of the printer body 1A and the front cover 13 illustrated in FIG. 2 are disposed on the side of the front surface of the printer body of the area A1. Therefore, even if attempt is made to pull out the pull-out unit 3, the jammed sheet S interferes with the frame or the like and the pull-out unit 3 cannot be pulled out or the sheet is torn. Hence, in this embodiment, when the rear end of the jammed sheet S is located in the area A1, the jammed sheet S is forcibly conveyed to the downstream until the rear end passes through the downstream end of the area A1.

In this embodiment, if a jam detecting signal is output, the rotating and driving operation of the fixing apparatus 45 is stopped and the fixing nip of the fixing roller 45*a* and the pressure roller 45*b* is opened. According to this, a case where a jammed sheet S on which a toner image is formed is held in a state that the jammed sheet S receives heat and pressure of the fixing apparatus 45 is eliminated, it is possible to prevent the fixing apparatus 45 from being damaged, and the jam recovery performance is also enhanced.

However, if the jammed sheet S is forcibly conveyed as described above, the rotating and driving operation is stopped, and the tip end of the jammed sheet S abuts against a roller surface whose fixing nip opens or against constituent parts around the fixing apparatus. As a result, especially when the sheet has high rigidity, the roller surface of the fixing apparatus 45 or the constituent parts around the fixing apparatus are damaged by abutment or friction of the tip end of the jammed sheet S, and there is an adverse possibility that image failure or trouble of the apparatus occurs. Hence, when a jammed sheet S is forcibly conveyed, it is necessary to control so that the tip end of the jammed sheet S does not reach the area A2.

Therefore, when a sheet jam occurs, the CPU 100 separates the secondary transfer roller 43 from the intermediate transfer belt 67, releases the fixing nip of the fixing apparatus 45, and release the suction force of the pre-fixing conveying apparatus 44. Thereafter, if the conveying sensor 101 (see FIG. 3) provided on the pull-out unit 3 detects a tip end of a sheet S, a rear end position of the jammed sheet S is calculated (computed) from this detection timing, the size information of the sheet S, and the driving time of each conveying roller are calculated. This size information of the sheet S (information of length of the sheet in the conveying direction of the sheet) is previously set by means of the operation portion (see FIG. 3) by a user, or is automatically detected by a sheet conveying direction length detecting portion (not illustrated).

The pre-registration rollers 41 and the registration rollers 42 are driven according to the length Ls of the jammed sheet S in the conveying direction of the sheet and the rear end position of the jammed sheet S, thereby accommodating the jammed sheet S in the pull-out unit 3. Then, the pull-out unit 3 is pulled out and the jam recovery is carried out.

Figure 5:
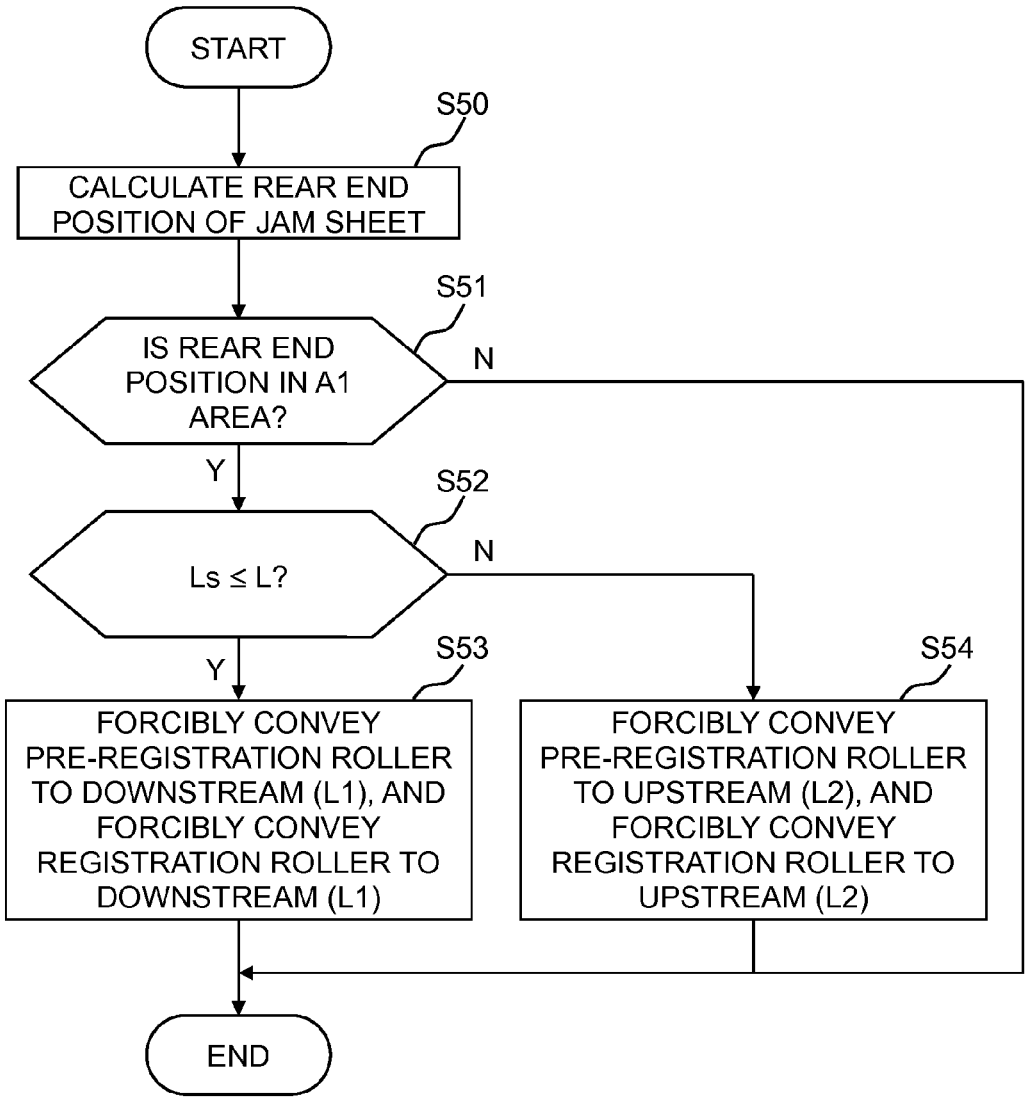
FIG. 5 is a flowchart for explaining the forcible conveyance control of the color laser beam printer.

Next, the forcible conveyance control in this embodiment will be described with reference to a flowchart illustrated in FIG. 5.

When the sheet jam occurs, the CPU 100 calculates a rear end position of the jammed sheet S (S50) and from the calculation result, determines whether the rear end position of the jammed sheet S is located within the area A1 (S51). When the rear end position of the jammed sheet S is located within the area A1 (YES in step S51), the CPU 100 determines whether the length Ls of the jammed sheet S in the conveying direction of the sheet is equal to or shorter than L (S52). When the rear end position of the jammed sheet S is not located within the area A1 (NO in step S51), since the pull-out unit 3 can be pulled out, the sheet is not forcibly conveyed.

Here, when Ls is equal to or shorter than L (YES in step S52) as illustrated in FIG. 4A, the pre-registration drive motor M2 and the registration drive motor M1 are normally rotated and driven. According to this, the pre-registration rollers 41 and the registration rollers 42 are normally rotated and driven as illustrated in FIG. 4B, and the jammed sheet S is forcibly conveyed toward the downstream by L1. According to this control, the jammed sheet S can be conveyed toward the downstream to a position where the rear end thereof passes through the area A1 in a state where the tip end of the jammed sheet S does not reach the area A2. According to this, the pull-out unit 3 can be pulled out thereafter and the jam recovery can be carried out.

When Ls of the jammed sheet S is longer than L as illustrated in FIG. 4C (NO in step S52), if the jammed sheet S is conveyed toward the downstream to the position where the rear end of the jammed sheet S passes through the area A1, the tip end reaches the area A2. Therefore, in this case, the CPU 100 reversely rotates and drives the pre-registration drive motor M2 and the registration drive motor M1. According to this, the pre-registration rollers 41 and the registration rollers 42 are reversely rotated and driven, and the jammed sheet S is forcibly conveyed toward the upstream by L2.

According to this control, the jammed sheet S can be forcibly conveyed to the position where the rear end thereof passes through the area A1 (position on the side of the sheet deck). According to this, the open guide 23 of the sheet deck 2 can be opened thereafter and the jam recovery can be carried out. This forcible conveyance control is carried out after the secondary transfer roller 43 is separated from the intermediate transfer belt 67 and the fixing nip of the fixing apparatus 45 is released and the suction force of the pre-fixing conveying apparatus 44 is released. Even if the driving operations thereof are stopped, the conveying forces of the pre-registration rollers 41 and the registration rollers 42 are not hindered.

As described above, in this embodiment, the jammed sheet S is conveyed until the rear end thereof passes through the downstream end of the area A1 or until the rear end passes through the upstream end of the area A1 according to the length Ls and the rear end position of the jammed sheet S. According to this, the opening operation of the area A1 is unnecessary, and it is possible to reliably carry out the jam recovery between the pull-out unit 3 and the area A1 with a simple configuration. According to this configuration, the jam recovery can be carried out without increasing the cost and the installation space of the printer body 1A without generating image failure and trouble of the fixing apparatus.

When the sheet jam occurs, an unfixed toner image is transferred to a jammed sheet S in a range from the nip of the secondary transfer portion to the fixing nip of the fixing apparatus 45. Therefore, when it is pulled out toward the upstream and the jam recovery is carried out, since there is a possibility that the unfixed toner image adheres to the upstream conveying guide and conveying roller and the inside of the apparatus is contaminated, the pull-out unit 3 can be pulled out and the jam recovery can be carried out.

Figure 6A:
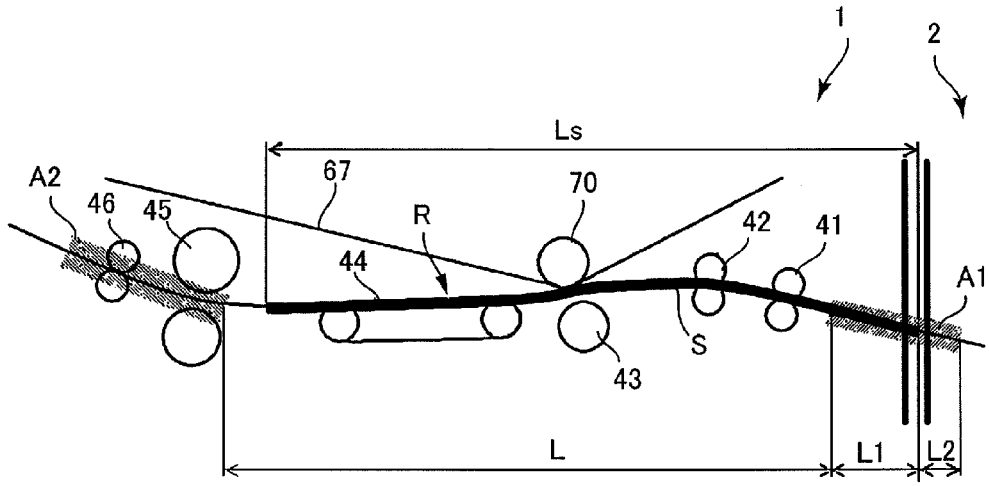
FIGS. 6A and 6B are diagrams for explaining forcible conveyance control of an image forming apparatus according to a second embodiment of the invention.
Figure 6B:
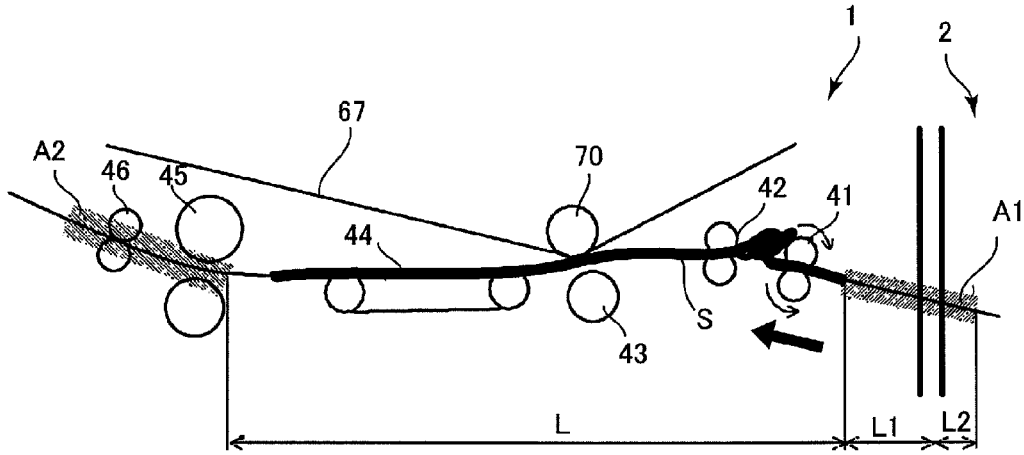

A second embodiment of the invention in which the pull-out unit 3 is pulled out as possible and the jam recovery is carried out will be described. FIGS. 6A and 6B are diagrams for explaining the forcibly conveying operation of an image forming apparatus according to the second embodiment. In this embodiment, rotating directions of the pre-registration drive motor M2 and the registration drive motor M1 are changed according to a length and rigidity of a jammed sheet. According to this, the jammed sheet is bent between the pre-registration rollers 41 which are upstream conveying roller of the two conveying rollers and the registration rollers 42 which are downstream conveying rollers of the two conveying rollers and a loop is formed.

For example, when the length Ls of a jammed sheet S is longer than L as illustrated in FIG. 6A and its rigidity is lower than a predetermined rigidity, an upstream end of the jammed sheet S in the conveying direction of the sheet is bent as illustrated in FIG. 6B. According to this, the jammed sheet S can be accommodated in the pull-out unit and then, the pull-out unit 3 can be pulled out and the jam recovery can be carried out.

Figure 7:
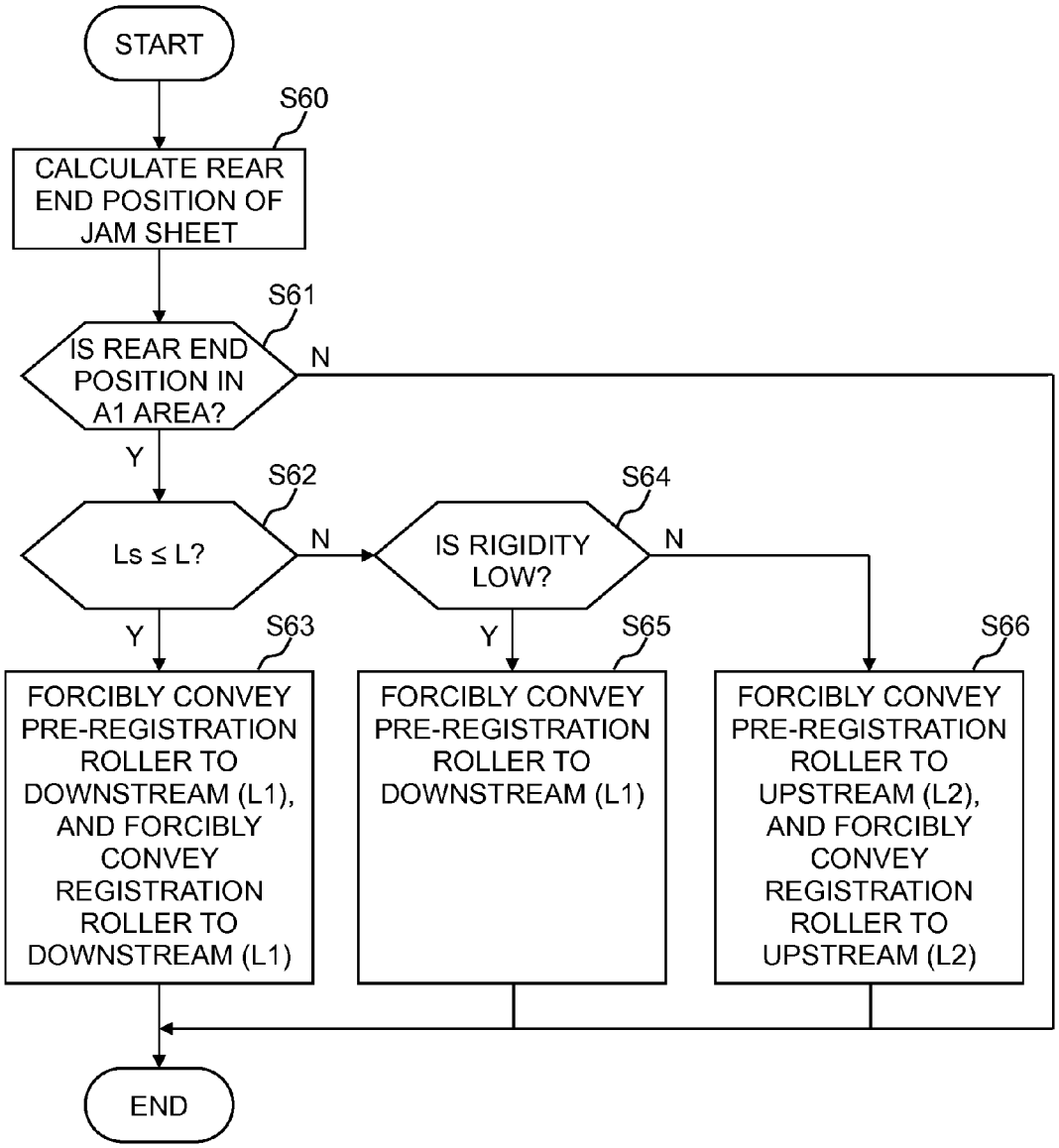
FIG. 7 is a flowchart for explaining the forcible conveyance control of the image forming apparatus.

Next, the forcible conveyance control in this embodiment will be described with reference to a flowchart illustrated in FIG. 7.

When a sheet jam occurs, the CPU 100 first calculates a rear end position of the jammed sheet S (S60) and from the calculation result, determines whether the rear end position of the jammed sheet S is located within the area A1 (S61). When the rear end position of the jammed sheet S is located within the area A1 (YES in step S61), the CPU 100 determines whether the length Ls of the jammed sheet S in the conveying direction of the sheet is equal to or shorter than L (S62). When the rear end position of the jammed sheet S is not located within the area A1 (NO in step S61), the jammed sheet S is not forcibly conveyed.

When Ls is equal to or shorter than L as illustrated in FIG. 4A (YES in step S62), the pre-registration drive motor M2 and the registration drive motor M1 are normally rotated and driven. According to this, as illustrated in FIG. 4B, the pre-registration rollers 41 and the registration rollers 42 are normally rotated and driven, and the jammed sheet S is forcibly conveyed toward the downstream by L1. According to this control, the jammed sheet S can be conveyed toward the downstream side to a position where the rear end thereof passes through the area A1 in a state where the tip end of the jammed sheet S does not reach the area A2. According to this, the jammed sheet S is accommodated and thereafter, the pull-out unit 3 can be pulled out and the jam recovery can be carried out.

On the other hand, when the length Ls of the jammed sheet S is longer than L (NO in step S62) as illustrated in FIG. 6A, it is determined whether the rigidity of the jammed sheet S is low based on rigidity information of the sheet which is input from the operation portion that is a rigidity information inputting portion (S64). When the rigidity of the jammed sheet S is low (YES in step S64), the pre-registration rollers 41 are normally rotated and driven such that the sheet is conveyed toward the downstream by L1 in a state where the driving operation of the registration rollers 42 is stopped as illustrated in FIG. 6B. Here, if the registration rollers 42 are stopped and the pre-registration rollers 41 are normally rotated and driven, the tip end of the jammed sheet S is stopped at a location before the area A2 and in this state, the sheet S is bent by L1 between the pre-registration rollers 41 and the registration rollers 42, and a loop Lp is formed. By bending the jammed sheet S and forming the loop Lp, the jammed sheet S can be forcibly conveyed toward the downstream to a position where the rear end of the jammed sheet S passes through the area A1.

As described above, even when Ls is longer than L, the jammed sheet S can be accommodated in the pull-out unit by looping the jammed sheet S. According to this, the pull-out unit 3 can be pulled out and the jam recovery can be carried out, and it is possible to prevent the apparatus from being contaminated by the unfixed toner image when the jam recovery is carried out. Since the loop Lp formed when the jam recovery is carried out is formed using a loop forming space for correcting skew feeding of a sheet S, the image forming apparatus is not increased in size. When rigidity of a jammed sheet S is not low (NO in step S64), i.e., when Ls of the jammed sheet S is longer than L and its rigidity is high, the pre-registration rollers 41 and the registration rollers 42 are reversely rotated and driven as in the first embodiment, and the sheet is forcibly conveyed by L2 (S66). According to this, it is possible to open the open guide 23 of the sheet deck 2 and to carry out the jam recovery.

As described above, in this embodiment, even if the length Ls of the jammed sheet S is longer than L, if its rigidity is low, the jammed sheet S can be accommodated in the pull-out unit by looping the jammed sheet S. According to this, the pull-out unit 3 can be pulled out and the jam recovery can be carried out, and it is possible to prevent the apparatus from being contaminated by the unfixed toner image when the jam recovery is carried out.

Although it is described above that the jammed sheet S is looped by stopping the driving operation of the registration rollers 42, the driving operation of the registration rollers 42 is not limited to this. If a jammed sheet S can be conveyed by respective predetermined distances, control is not limited. That is, control may be performed such that velocity of the registration rollers 42 is made constant and driving time is changed, or such that the driving time is made constant and the velocity is changed, or both the cases may be combined.

As a reference (predetermined rigidity) of low rigidity, when rigidity is not displayed, since the rigidity is proportional to basis weight, the reference may be determined based on the basis weight. For example, rigidity may be determined as low when basis weight of plain paper is 105 g/m$^2$ or less, but this embodiment is not limited to this, and rigidity may be determined as low if a sheet S is bent between the pre-registration rollers 41 and the registration rollers 42 and loop Lp can be formed.

In this embodiment, rigidity of a sheet is determined based on information such as kind, basis weight and size of a sheet S selected by the operation portion when a user sets a sheet S in the sheet cassette 11. When a media sensor capable of measuring rigidity, thickness, gap, density or material is provided in the image forming apparatus, rigidity may be determined using detection information from the media sensor.

In this embodiment, when a sheet jam occurs, if a length Ls of the jammed sheet S is longer than L and rigidity thereof is low, the driving operation of the registration rollers 42 is stopped. Alternatively, the driving operation of the registration rollers 42 may be stopped after the sheet is conveyed to a location before the area A2.

Figure 8A:
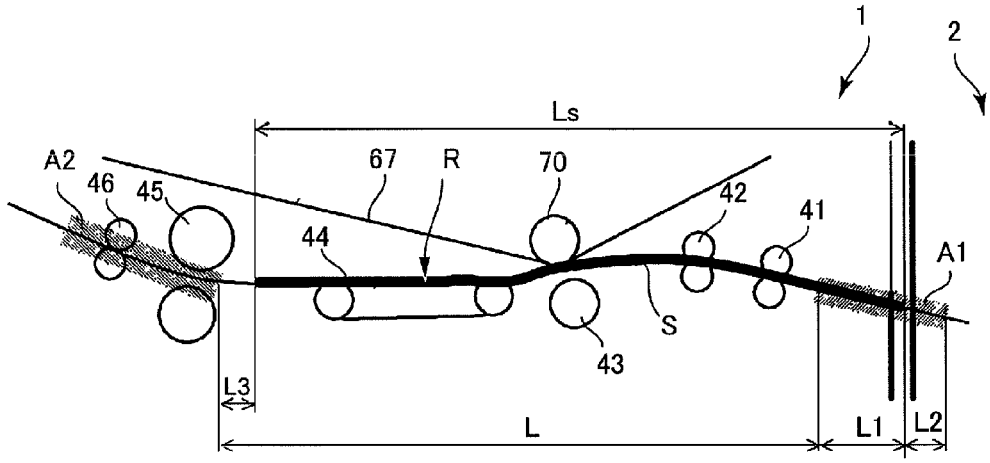
FIGS. 8A and 8B are diagrams for explaining forcible conveyance control of an image forming apparatus according to a third embodiment of the invention.
Figure 8B:
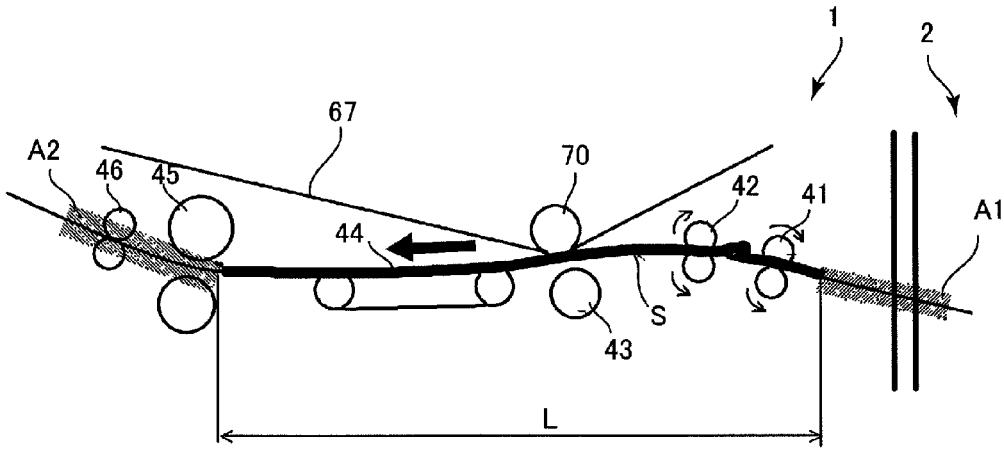

Next, a third embodiment of the invention will be described. FIGS. 8A and 8B are diagrams for explaining the forcibly conveying operation of an image forming apparatus according to the third embodiment. In the third embodiment, rotation directions of the pre-registration drive motor M2 and the registration drive motor M1 are changed according to a length and rigidity of a jammed sheet S. In FIG. 8A, a reference symbol L3 represents a distance between a tip end of a jammed sheet S and an upstream end of the area A2. In this embodiment, like the rear end position, a tip end position of a jammed sheet S is calculated from timing at which a conveying sensor detects a tip end of the sheet, size information in a conveying direction of the sheet S which is previously set by a user or automatically detected, and driving time of each conveying roller.

In this embodiment, when a length Ls of a jammed sheet S is longer than L and rigidity thereof is low, the jammed sheet S is conveyed such that a tip end thereof approaches a location before the area A2, and a loop Lp is formed between the pre-registration rollers 41 and the registration rollers 42. In the case of the configuration of this embodiment, the loop Lp is formed by the same length as (L1-L3) of an upstream end of the jammed sheet S, the loop amount can be set smaller by L3, and this embodiment can be applied also to a sheet S having higher rigidity.

Figure 9:
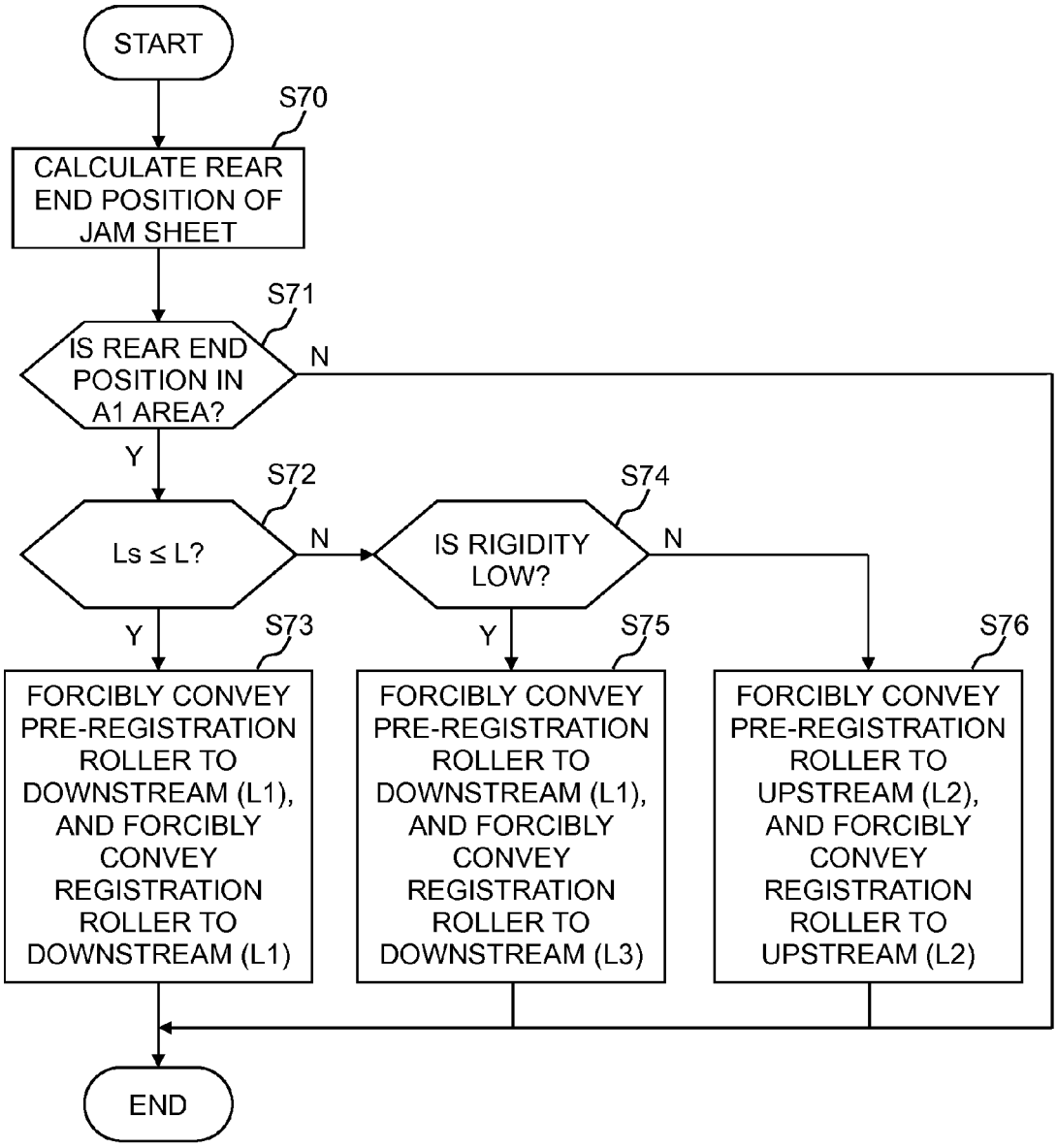
FIG. 9 is a flowchart for explaining the forcible conveyance control of the image forming apparatus.

Next, forcible conveyance control of this embodiment will be described with reference to a flowchart illustrated in FIG. 9.

When a sheet jam occurs, the CPU 100 first calculates a rear end position of the jammed sheet S (S70) and from the calculation result, determines whether the rear end position of the jammed sheet S is located within the area A1 (S71). When the rear end position of the jammed sheet S is located within the area A1 (YES in step S71), the CPU 100 then determines whether the length Ls of the jammed sheet S in the conveying direction of the sheet is equal to or shorter than L (S72). If the rear end position of the jammed sheet S is not located within the area A1 (NO in step S71), the jammed sheet S is not forcibly conveyed.

As illustrated in FIG. 4A, if Ls is equal to or shorter than L (YES in step S72), the pre-registration drive motor M2 and the registration drive motor M1 are normally rotated and driven. According to this, as illustrated in FIG. 4B, the pre-registration rollers 41 and the registration rollers 42 are normally rotated and driven, and the jammed sheet S is forcibly conveyed toward the downstream by L1. According to this control, the jammed sheet S can be conveyed toward the downstream to a position where the rear end thereof passes through the area A1 in a state where the tip end of the jammed sheet S does not reach the area A2. According to this, the pull-out unit 3 can be pulled out thereafter and the jam recovery can be carried out.

As illustrated in FIG. 8A, when Ls of the jammed sheet S is longer than (NO in step S72), it is then determined whether rigidity of the jammed sheet S is low (S74). If the rigidity of the jammed sheet S is low (YES in step S74), the registration rollers 42 are normally rotated and driven, the jammed sheet S is conveyed to the downstream by L3 and the jammed sheet S is conveyed by the pre-registration rollers 41 toward the downstream by L1 as illustrated in FIG. 8B. When L1 is longer than L3, the loop Lp is formed by the amount of (L1-L3).

That is, when the rigidity of the jammed sheet S is low, the jammed sheet S is conveyed toward the downstream by the pre-registration rollers 41 by L1, and is conveyed by the registration rollers 42 by L3. According to this, a tip end of the jammed sheet S is stopped at a location before the area A2, a loop Lp is formed by the amount (L1-L3) between the pre-registration rollers 41 and the registration rollers 42, and the jammed sheet S can be forcibly conveyed to a location where the rear end passes through the area A1. As described above, even if the Ls is longer than L, the jammed sheet S can be accommodated in the pull-out unit by looping the sheet. According to this, the pull-out unit 3 can be pulled out and the jam recovery can be carried out, and it is possible to prevent the apparatus from being contaminated by the unfixed toner image when the jam recovery is carried out.

When rigidity of a jammed sheet S is not low (NO in step S74), i.e., when Ls of the jammed sheet S is longer than L and rigidity thereof is high, the pre-registration rollers 41 and the registration rollers 42 are reversely rotated and driven and the jammed sheet S is forcibly conveyed by L2 (S76) as in the first embodiment. According to this, it is possible to open the open guide 23 of the sheet deck 2 and to carry out the jam recovery.

As described above, in this embodiment, the pre-registration rollers 41 convey the jammed sheet S by L1, and the registration rollers 42 convey the jammed sheet S by L3. According to this, the tip end of the jammed sheet S is conveyed to a location before the area A2, a loop Lp is formed between the pre-registration rollers 41 and the registration rollers 42 by (L1-L3), and the jammed sheet S is forcibly conveyed to a position where the rear end passes through the area A1. According to this, the pull-out unit 3 can be pulled out thereafter and the jam recovery can be carried out.

According to this embodiment, as compared with a case where the driving operation of the registration rollers 42 is stopped, the loop amount can be set smaller by the amount of L3. Therefore, even if a sheet S has high rigidity, a loop can be formed. As a result, an application range of sheet in which the pull-out unit 3 is pulled out and the jam recovery is carried out can be widened.

In the above-described first to third embodiments, in the case of a jammed sheet S having Ls longer than L and having a rear end located in the area A1, forcibly conveyance of a sheet having such a size that a tip end thereof does not reach the area A2 is described, but the invention is not limited to this. For example, even when a jammed sheet S has such a length that a rear end of the sheet is located within the area A1 and a tip end thereof enters the range of the area A2, the invention can be applied.

Figure 10A:
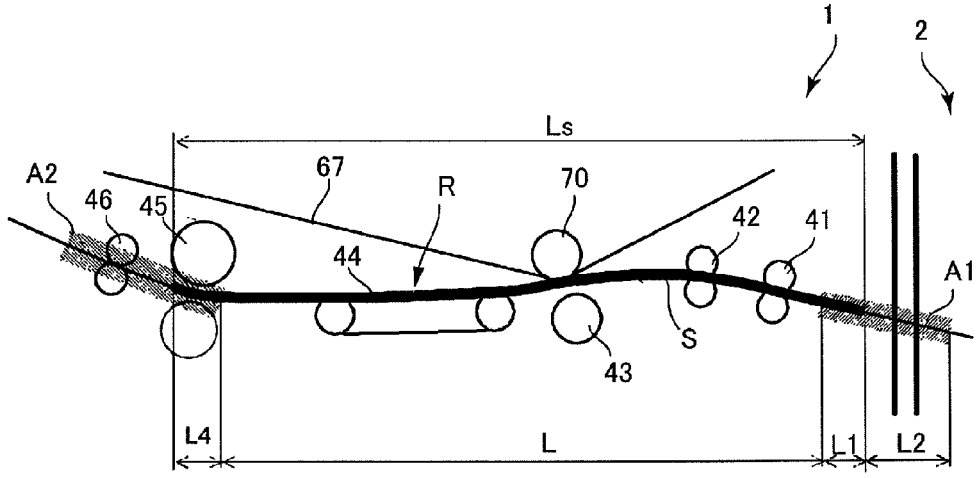
FIGS. 10A and 10B are diagrams for explaining forcible conveyance control of an image forming apparatus according to a fourth embodiment of the invention.
Figure 10B:
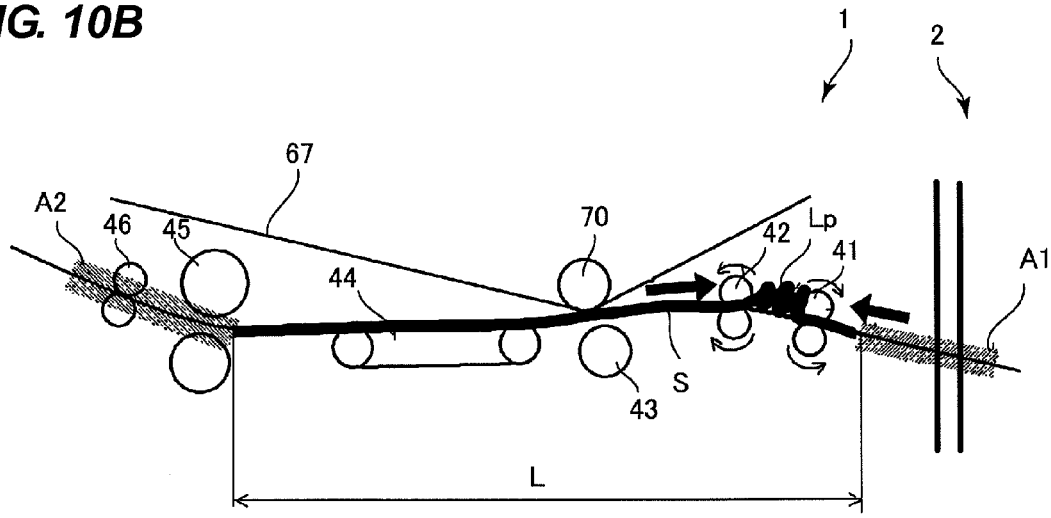

Next, a fourth embodiment of the invention will be described. FIGS. 10A and 10B are diagrams for explaining forcible conveyance control of an image forming apparatus according to the fourth embodiment of the invention. In FIGS. 10A and 10B, a reference symbol L4 represents an entering distance of a tip end of a jammed sheet S into the area A2.

Figure 11:
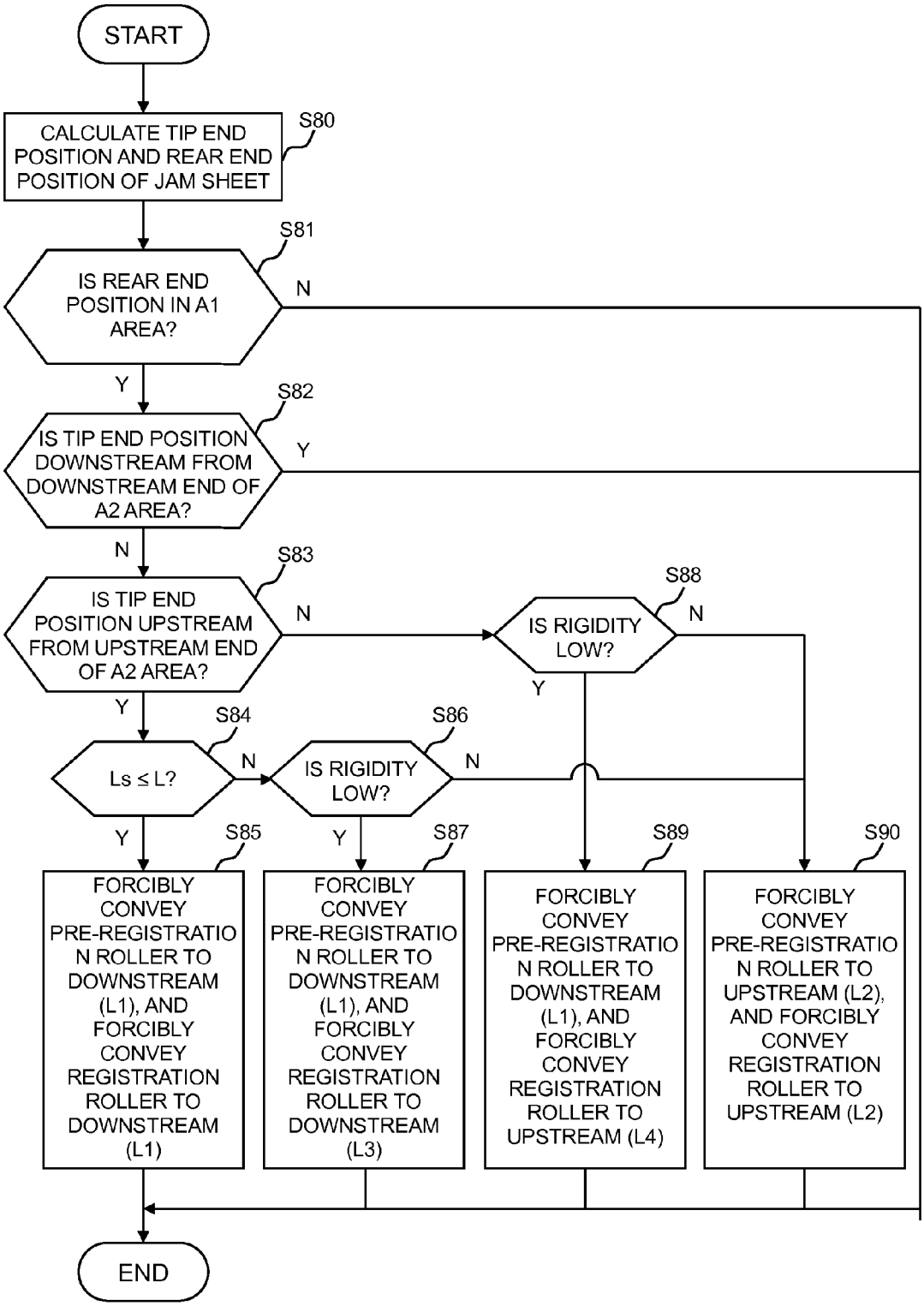
FIG. 11 is a flowchart for explaining the forcible conveyance control of the image forming apparatus.

Next, the forcible conveyance control of this embodiment in which a jammed sheet S has such a length that a rear end thereof is located within the area A1 and a tip end thereof enters the area A2 will be described with reference to a flowchart illustrated in FIG. 11.

When a sheet jam occurs, the CPU 100 first calculates a tip end position and a rear end position of the jammed sheet S (S80) and from the calculation result, determines whether the rear end position of the jammed sheet S is within the area A1 (S81). If the rear end position of the jammed sheet S is within the area A1 (YES in step S81), the CPU 100 determines whether the tip end position is downstream from the downstream end of the area A2 (S82). If the rear end position of the jammed sheet S is not within the area A1 (NO in step S81), the jammed sheet S is not forcibly conveyed. If the tip end position is downstream from the downstream end of the area A2 (YES in step S82), and by opening an inversion door 14, a user grasps the tip end of the jammed sheet S and pulls it out toward the downstream and jam recovery is carried out. That is, when the tip end position is downstream from the area A2, the forcible conveyance control is not carried out.

Next, when the tip end position is not downstream from the area A2 (NO in step S82), it is determined whether the tip end position is upstream from the upstream end of the area A2 (S83). If the tip end position is upstream from the upstream end of the area A2, i.e., when the tip end of the jammed sheet S does not enter the area A2 (YES in step S83), it is then determined whether the length Ls of the jammed sheet S in the conveying direction of the sheet is equal to or shorter than L (S84).

Here, when Ls is equal to or shorter than L (YES in step S84), the pre-registration drive motor M2 and the registration drive motor M1 are normally rotated and driven. According to this, as illustrated in FIG. 4B, the pre-registration rollers 41 and the registration rollers 42 are normally rotated and driven, and the jammed sheet S is forcibly conveyed toward the downstream by L1. According to this control, the jammed sheet S can be conveyed toward the downstream to a position where the rear end thereof passes through the area A1 in a state where the tip end of the jammed sheet S does not reach the area A2. According to this, the pull-out unit 3 can be pulled out thereafter and the jam recovery can be carried out.

When the length Ls of the jammed sheet S is longer than L (NO in step S84), it is then determined whether the rigidity of the jammed sheet S is low (S86). Here, if the rigidity of the jammed sheet S is low (YES in step S86), as illustrated in FIG. 8B, the registration rollers 42 are normally rotated and driven, the jammed sheet S is conveyed toward the downstream by L3, and the jammed sheet S is conveyed by the pre-registration rollers 41 toward the downstream by L1. According to this, a tip end of the jammed sheet S is stopped at a location before the area A2, a loop Lp is formed by the amount (L1-L3) between the pre-registration rollers 41 and the registration rollers 42, and the jammed sheet S can be forcibly conveyed to a location where the rear end passes through the area A1.

When the rigidity of the jammed sheet S is not low (NO in step S86), i.e., when Ls of the jammed sheet S is longer than L and the rigidity thereof is high, the pre-registration rollers 41 and the registration rollers 42 are reversely rotated and driven and the jammed sheet S is forcibly conveyed by L2 as in the first embodiment. According to this, it is possible to open the open guide 23 of the sheet deck 2 and to carry out the jam recovery.

As illustrated in FIG. 10A, when the tip end position is downstream from the upstream end of the area A2 (NO in step S83), it is then determined whether the rigidity of the jammed sheet S is low (S88). Here, if the rigidity of the jammed sheet S is low (YES in step S88), the registration rollers 42 are reversely rotated and driven to convey the jammed sheet S toward the upstream by L4 and the pre-registration rollers 41 are normally rotated and driven to convey the jammed sheet S toward the downstream by L1 as illustrated in FIG. 10B.

According to this control, the jammed sheet S can be conveyed toward the upstream to a location where a tip end position is before the area A2. A loop Lp is formed by the amount (L1+L4) between the pre-registration rollers 41 and the registration rollers 42, and the jammed sheet S can be conveyed toward the downstream to a location where the rear end passes through the area A1.

The tip end of the jammed sheet S is conveyed to a location before the area A2, the loop Lp is formed, and the jammed sheet S is forcibly conveyed toward the downstream to a location where the rear end passes through the area A1. According to this, the pull-out unit 3 can be pulled out and the jam recovery can be carried out. Even if the jammed sheet S flutters while the pull-out unit 3 is operated, since the jammed sheet S is held at a location where its tip end does not reach the fixing apparatus 45, a surface of the fixing apparatus 45 and constituent parts around the fixing apparatus are not damaged.

When the rigidity of the jammed sheet S is not low (NO in step S88), the pre-registration rollers 41 and the registration rollers 42 are reversely rotated and driven, and the jammed sheet S is forcibly conveyed by L2 (S90). According to this, it is possible to open the open guide 23 of the sheet deck 2 and to carry out the jam recovery.

As described above, in this embodiment, when it is determined that the rear end is located in the area A1 and the tip end is located in the area A2 and its rigidity is lower than a predetermined value, the registration rollers 42 are reversely rotated and driven to convey the jammed sheet S until the tip end thereof passes through the upstream end of the area A2. The pre-registration rollers 41 are normally rotated. While the jammed sheet S is bent, the jammed sheet S is conveyed until its rear end passes through the downstream end of the area A1. According to this, the pull-out unit 3 can be pulled out thereafter and the jam recovery can be carried out.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-042837, filed Feb. 26, 2010, which is hereby incorporated by reference herein in its entirety.

What is claimed is:

1. An image forming apparatus including a pull-out unit provided in an apparatus body such that the pull-out unit can be pulled out and having a sheet conveying passage and two conveying rollers which are provided in the sheet conveying passage and which can normally and reversely rotate, the image forming apparatus comprising:

an upstream sheet conveying passage provided upstream from the pull-out unit in a sheet conveying direction for conveying a sheet to the pull-out unit;

a downstream sheet conveying passage provided downstream from the pull-out unit in the sheet conveying direction for conveying the sheet from the pull-out unit;

a rigidity information inputting portion for inputting rigidity information of a sheet;

a jam detecting portion which detects a sheet jam;

a sheet detecting portion which detects a sheet that passes through the sheet conveying passage of the pull-out unit; and a controlling portion which controls driving operations of the two conveying rollers, and wherein when the jam detecting portion detects a sheet jam, the controlling portion calculates a rear end position of the jammed sheet based on detection of the sheet detecting portion, and the controlling portion controls driving operations of the two conveying rollers such that when a rear end of the jammed sheet is in the upstream sheet conveying passage, and when a distance L between the upstream sheet conveying passage and the downstream sheet conveying passage is equal to or longer than a length Ls of the jammed sheet in a conveying direction of the sheet, the jammed sheet is conveyed toward a downstream until the rear end of the sheet passes through a downstream end of the upstream sheet conveying passage, when Ls is longer than L, the controlling portion controls the driving operations of the two conveying rollers based on the rigidity information from the rigidity information inputting portion, and controls the driving operations of the two conveying rollers such that when it is determined that the rigidity of the jammed sheet is equal to or higher than a predetermined rigidity, the jammed sheet is conveyed toward the upstream until the rear end passes through the upstream end of the upstream sheet conveying passage, and when it is determined that the rigidity of the jammed sheet is lower than the predetermined rigidity, the jammed sheet is conveyed to the downstream until the rear end passes through the downstream end of the upstream sheet conveying passage while bending the jammed sheet between the two conveying rollers.

2. The image forming apparatus according to claim 1, wherein when Ls is longer than L, the controlling portion controls the driving operations of the two conveying rollers based on the rigidity information from the rigidity information inputting portion, and controls the driving operations of the two conveying rollers such that when it is determined that the rigidity of the jammed sheet is lower than the predetermined rigidity, the jammed sheet is conveyed to the downstream until the rear end passes through the downstream end of the upstream sheet conveying passage while bending the jammed sheet between the two conveying rollers, and the tip end of the jammed sheet is made to approach the downstream sheet conveying passage.

3. The image forming apparatus according to claim 1, wherein when a length of the jammed sheet in the conveying direction of the sheet has such a value that the rear end of the sheet is located in the upstream sheet conveying passage and the tip end of the sheet is located in the downstream sheet conveying passage, and when it is determined that the rigidity of the sheet is lower than the predetermined rigidity based on the rigidity information from the rigidity information inputting portion, the controlling portion performs control such that one of the two conveying rollers which is located downstream is reversely rotated to convey the jammed sheet until its tip end passes through the upstream end of the downstream sheet conveying passage, one of the two conveying rollers located upstream is normally rotated to convey the jammed sheet until the rear end of the sheet passes through the downstream end of the upstream sheet conveying passage while bending the jammed sheet between the two conveying rollers.

4. The image forming apparatus according to claim 3, wherein one of the two conveying rollers located downstream is a registration roller which forms a loop in a loop forming space between the upstream conveying roller and the registration roller to correct skew feeding of a sheet, and even when Ls is longer than L, if the rigidity of the jammed sheet is lower than the predetermined rigidity, the jammed sheet is bent in the loop forming space.

5. The image forming apparatus according to claim 1, further comprising a fixing portion for fixing an image formed on a sheet, wherein the fixing portion is provided in the downstream sheet conveying passage.

* * * * *